US008070547B2

(12) United States Patent
Motoki et al.

(10) Patent No.: US 8,070,547 B2
(45) Date of Patent: Dec. 6, 2011

(54) METHOD FOR MANUFACTURING IMAGE DISPLAY APPARATUS

(75) Inventors: Yohei Motoki, Atsugi (JP); Akihiro Kimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/823,216

(22) Filed: Jun. 25, 2010

(65) Prior Publication Data

US 2011/0009025 A1 Jan. 13, 2011

(30) Foreign Application Priority Data

Jul. 8, 2009 (JP) ..... 2009-161327

(51) Int. Cl.
*H01J 9/00* (2006.01)
*H01J 9/24* (2006.01)

(52) U.S. Cl. ..... 445/25; 445/24

(58) Field of Classification Search ..... 445/24, 445/25

See application file for complete search history.

(56) References Cited

U.S. PATENT DOCUMENTS

| | | | | |
|---|---|---|---|---|
| 7,063,585 | B2 | 6/2006 | Hayama | |
| 7,258,588 | B2 * | 8/2007 | Yakou et al. | 445/24 |
| 7,547,240 | B2 * | 6/2009 | Shioya et al. | 445/25 |
| 2004/0171470 | A1 | 9/2004 | Hayama | |
| 2009/0205849 | A1 | 8/2009 | Kimura et al. | |

FOREIGN PATENT DOCUMENTS

| | | | |
|---|---|---|---|
| JP | 2004-152602 | A | 5/2004 |
| JP | 2006-031972 | A | 2/2006 |

* cited by examiner

*Primary Examiner* — Mariceli Santiago

(74) *Attorney, Agent, or Firm* — Fitzpatrick, Cella, Harper & Scinto

(57) ABSTRACT

A spacer having bending portions in the vicinity of end portions is used, and grip portions provided between the end portions and the bending portions are held by holding units. Tension is applied to the spacer in a longitudinal direction, and the grip portions are rotated to release a rotational moment applied to a longitudinal portion of the spacer. In this state, the spacer is attached to a rear plate.

1 Claim, 7 Drawing Sheets

METHOD FOR MANUFACTURING IMAGE DISPLAY APPARATUS

BACKGROUND OF THE INVENTION

1. Field of the Invention

The present invention relates to a method for manufacturing an image display apparatus in which two substrates face each other with plate-like spacers interposed therebetween, and more particularly, to a method for manufacturing an image display apparatus including a process of attaching spacers to one substrate.

2. Description of the Related Art

In general, in an image display apparatus including two substrates that are arranged so as to face each other, as members resistant to atmospheric pressure, spacers are interposed between two substrates. Japanese Patent Application Laid-Open No. 2004-152602 discloses a method which accurately attaches linear spacers to a rear plate on which electron emitting devices are arranged at a small pitch, in order to reduce the size of a device. Specifically, in the method, when the spacers are attached to the plate, tension is applied in the longitudinal direction of the spacer, and a region in which the spacer is fixed to the rear plate is disposed inside the point where the tension is applied, in order to maintain the linearity of the spacer by the tension. In addition, Japanese Patent Application Laid-Open No. 2006-31972 discloses long spacers that are provided between a pair of panels facing each other, in order to reduce manufacturing costs. At least one end portion of the spacer is bent at a predetermined angle, as viewed from the panel.

SUMMARY OF THE INVENTION

This invention uses the following construction, a method for manufacturing an image display apparatus having a first substrate, a second substrate that is arranged so as to face the first substrate, and a plate-like spacer that is provided between the first substrate and the second substrate, wherein the spacer includes bending portions that are provided on the inside of both end portions and are bent in a plane orthogonal to a direction in which the first substrate and the second substrate face each other, the method comprising the steps of:

holding grip portions that are provided between the bending portions and the end portions of the spacer;

applying tension to the spacer whose grip portions are held in a longitudinal direction of the spacer;

rotating the grip portions of the spacer in a direction in which the tension is applied to the spacer in the longitudinal direction in the plane orthogonal to the direction in which the first substrate and the second substrate face each other; and fixing a portion of the spacer that is disposed at least inside the bending portions to the first substrate.

Further features of the present invention will become apparent from the following description of exemplary embodiments with reference to the attached drawings.

DESCRIPTION OF THE EMBODIMENTS

Figure 1A:
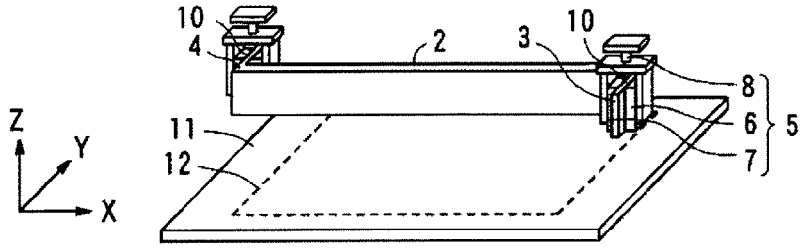
FIGS. 1A to 1E are diagrams schematically illustrating a process of attaching spacers to a rear plate according to an embodiment of the invention.

In the method disclosed in Japanese Patent Application Laid-Open No. 2004-152602, when the linear spacer is provided, it is necessary to form a region for applying tension to the spacer outside a spacer fixing region. In addition, in order to obtain adhesion strength required to prevent the spacer from being detached from the rear plate, it is necessary to increase the area of the region in which the spacer is fixed by the adhesive, which results in an increase in the area of a non-image region (dead space) of the image display apparatus. It is preferable to reduce the dead space in order to reduce the weight of the image display apparatus and improve the design thereof.

In order to attach the spacers disclosed in Japanese Patent Application Laid-Open No. 2006-31972 to the rear plate having the electron emitting devices formed thereon at a small pitch to reduce the size of the image display apparatus, high attachment accuracy is needed and the spacers need to have high linearity.

The invention has been made in order to solve the above issues, and an object of the invention is to provide a method for manufacturing an image display apparatus in which spacers are attached to a substrate having electron emitting devices formed thereon at a small pitch with high linearity and high accuracy while reducing a dead space and which can display a high-quality image and has high reliability.

According to the invention, it is possible to accurately attach the spacers to the substrate by rotating grip portions of the spacer having bending portions. As a result, it is possible to provide an image display apparatus with a light weight, a small size, and a small dead space.

A method for manufacturing an image display apparatus according to the invention includes, for example, a method for manufacturing a liquid crystal display, a plasma display, or an electron beam display. In particular, the electron beam display is an example to which the invention is applied since it is a high-vacuum container. Hereinafter, a method for manufacturing an electron beam display according to an embodiment of the invention will be described in detail with reference to FIGS. 1A to 4.

FIGS. 2A to 2D are diagrams illustrating examples of the spacer according to the embodiment of the invention. FIGS. 2A to 2D illustrate the spacers as viewed from the Z direction, when the spacers are provided on a substrate extending in the XY plane. In FIGS. 2A to 2D, reference numeral 1 denotes a spacer, reference numeral 2 denotes a longitudinal portion of the spacer 1, reference numeral 3 denotes an end portion, and reference numeral 4 denotes a bending portion.

The longitudinal portion 2 may also be called an extended portion that extends in a first direction X (X direction). In the examples illustrated in FIGS. 2A to 2D, two bending portions 4 and two end portions 3 are provided. One of the bending portions 4 is disposed between one of the end portions 3 and the extended portion, and the other bending portion 4 is disposed between the other end portion 3 and the extended portion. The two bending portions 4 are bent in a direction different from the first direction X (X direction).

The spacer 1 used in the embodiment of the invention is a plate member that is provided between a first substrate (rear plate) and a second substrate (face plate) which face each other. The spacer 1 may be made of, for example, quartz glass, soda lime glass, or metal. It is preferable that the spacer 1 be made of the same material as that forming the rear plate 11 to which the spacers 1 are attached in order to make the linear expansion coefficients close to each other.

Figure 2A:
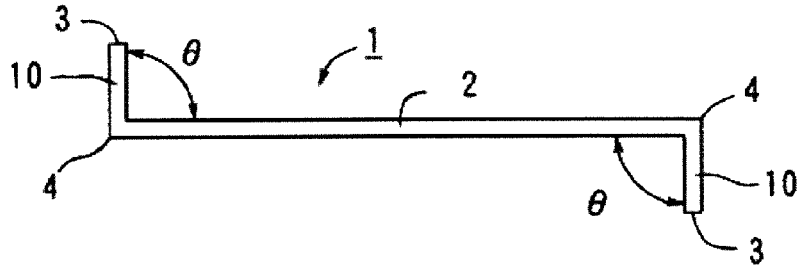
FIGS. 2A to 2D are diagrams illustrating examples of the shape of the spacer.
Figure 2B:
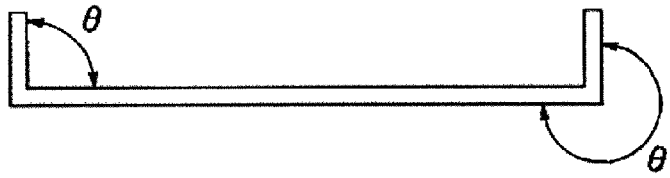
Figure 2C:
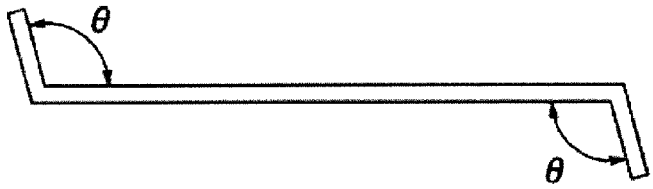
Figure 2D:
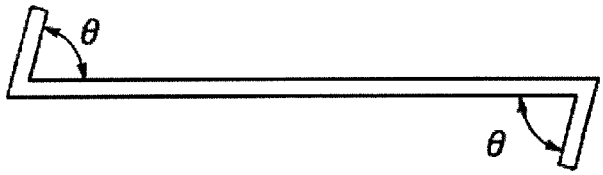
Figure 2D:
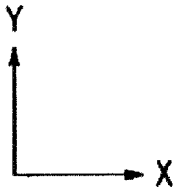

The spacer 1 used in this embodiment of the invention includes the bending portions 4 on the inside of both end portions 3 in the XY plane. It is assumed that a direction opposite to the direction in which the substrate extends (XY plane) is the Z direction. In the spacer 1, the bending portions 4 are bent at an angle θ. It is assumed that the angle θ is positive in the counterclockwise direction from the longitudinal portion 2 to the end portion 3. FIG. 2A illustrates an example in which the angles θ of both bending portions 4 are 90°. FIG. 2B illustrates an example in which the angle θ of one of the bending portions is 90° and the angle θ of the other bending portion is 270°. FIG. 2C illustrates an example in which the angles θ of both bending portions are more than 90°. FIG. 2D illustrates an example in which the angles θ of both bending portions are less than 90°.

The bending portions 4 are formed by a heat process of partially heating a portion of the spacer 1 in which the bending portions 4 are desired to be formed with, for example, a laser or a burner and softening the spacer, or a bending process of applying external force to bend a portion of the spacer with, for example, a vise. In particular, it is preferable to form the bending portions 4 using the laser in terms of processing accuracy.

Figure 3:
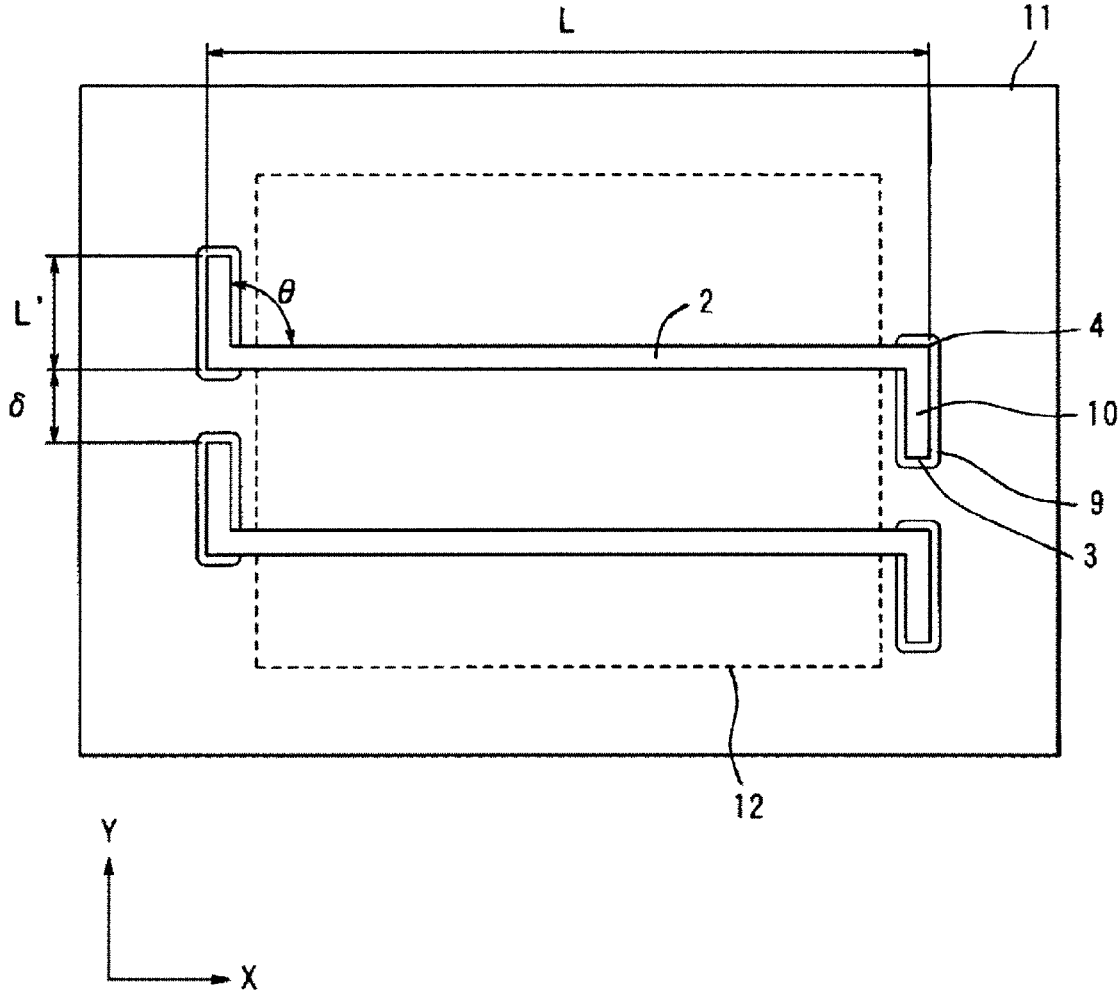
FIG. 3 is a diagram illustrating the arrangement of the spacers on the rear plate.

FIG. 3 is a diagram schematically illustrating the attachment of the spacers 1 illustrated in FIG. 2A to the rear plate 11 in this embodiment of the invention. In FIG. 3, the length (X direction) L of the longitudinal portion 2 of the spacer 1 is determined by the size of the rear plate and is generally in the range of 30 mm to 2540 mm. When the distance 8 from one end portion 3 of the spacer 1 to the bending portion 4 of an adjacent spacer is equal to or less than 2 mm, it is difficult to perform evacuation. Therefore, it is preferable that the distance 8 be equal to or more than 5 mm. The length L' from the end portion 3 to the bending portion 4 is determined by the pitch between the spacers 1 and the distance 6 to the bending portion 4 of an adjacent spacer 1.

It is preferable that the thickness of the spacer (Y direction) be in the range of 0.03 mm to 0.50 mm. It is difficult to perform luminescent display in portions of the face plate (not illustrated) and the rear plate 11 that come into contact with the spacers 1. Therefore, the thickness of the spacer 1 needs to be reduced so as not to exceed the size of wiring lines that are formed at a small pitch. However, when the thickness of the spacer 1 is too small, the strength of the spacer 1 is insufficient during the holding of the spacers 1 or the adhesion between the face plate and the rear plate 11. Therefore, the spacer 1 needs to have a thickness capable of ensuring necessary strength.

It is preferable that the thickness of the spacer 1 (Z direction) be in the range of 0.1 mm to 5.0 mm. In the image display apparatus, in general, a high accelerating voltage (0.1 kV to 20 kV) is used in order to improve the emission efficiency of phosphors of the face plate. Therefore, when the gap between the face plate and the rear plate 11 is too large, the trajectory of the electron beam emitted from the electron emitting device is curved. Therefore, it is preferable that the height of the spacer 1 be low.

It is preferable that the angle θ of the bending portions 4 of the spacer 1 be 90° or 270° as illustrated in FIGS. 2A and 2B. In this case, it is possible to reduce the dead space of the image display apparatus. However, the angle θ of the bending portion 4 is not limited to 90° or 270°, but the bending portion 4 may be bent at an obtuse angle or an acute angle, as illustrated in FIGS. 2C and 2D.

Next, a process of attaching the spacers 1 to the rear plate 11 in the method for manufacturing the image display apparatus according to this embodiment of the invention will be described.

FIGS. 1A to 1E are diagrams schematically illustrating a process of attaching the spacer 1 in which the angle θ of the bending portion 4 is 90° as illustrated in FIG. 2A to the rear plate 11.

A holding unit 5 for holding the spacer 1 used in this embodiment includes a basis claw 6 and a movable claw 7. The movable claw 7 is moved to open or close a space between the movable claw 7 and the basis claw 6 to hold the spacer 1. One holding unit 5 is fixed and the other holding unit 5 can be moved by an air cylinder (not illustrated) in the direction of an arrow A in FIG. 1B. Therefore, it is possible to apply tension in the longitudinal direction of the spacer 1.

A rotation shaft 8 extending in the Z direction is provided in the holding unit 5, and the holding unit 5 can be rotated on the rotation shaft 8. In this way, the holding unit 5 can be rotated in the plane (XY plane) orthogonal to the direction (Z direction) in which the face plate and the rear plate 11 face each other, and it is possible to apply a rotational moment around the Z-axis to the end portion 3 of the spacer 1.

A fixing member 9 is formed outside an image region 12 of the rear plate 11 in which the electron emitting devices are formed and fixes the spacer 1 at a predetermined position of the rear plate 11. The fixing member 9 is, for example, an adhesive or a fixing pin, but is not limited thereto. A detailed example of the process of attaching the spacer 1 to the rear plate 11 will be described below.

(Process of Holding Spacer 1: FIG. 1A)

Grip port ions 10 of the spacer 1 are disposed between the end portion 3 and the left and right bending portions 4 that are formed outside the image region 12 in order to avoid a region that comes into contact with the image region 12 of the rear plate 11. A process of holding the spacer 1 is performed by moving the movable claw 7 of the holding unit 5 to open or close the space between the movable claw 7 and the basis claw 6 and holding the grip portions 10. In this case, when the left and right grip portions 10 of the spacer 1 are held, the surfaces of the left and right basis claws 6 that come into contact with the grip portions are adjusted so as to be spaced at equal distances from the origin of the device in the horizontal direction, in order to prevent the damage of the spacer 1.

Figure 1B:
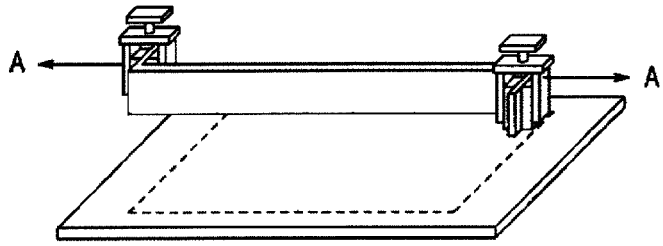

(Process of Applying Tension in X Direction of Spacer 1: FIG. 1B)

Figure 4:
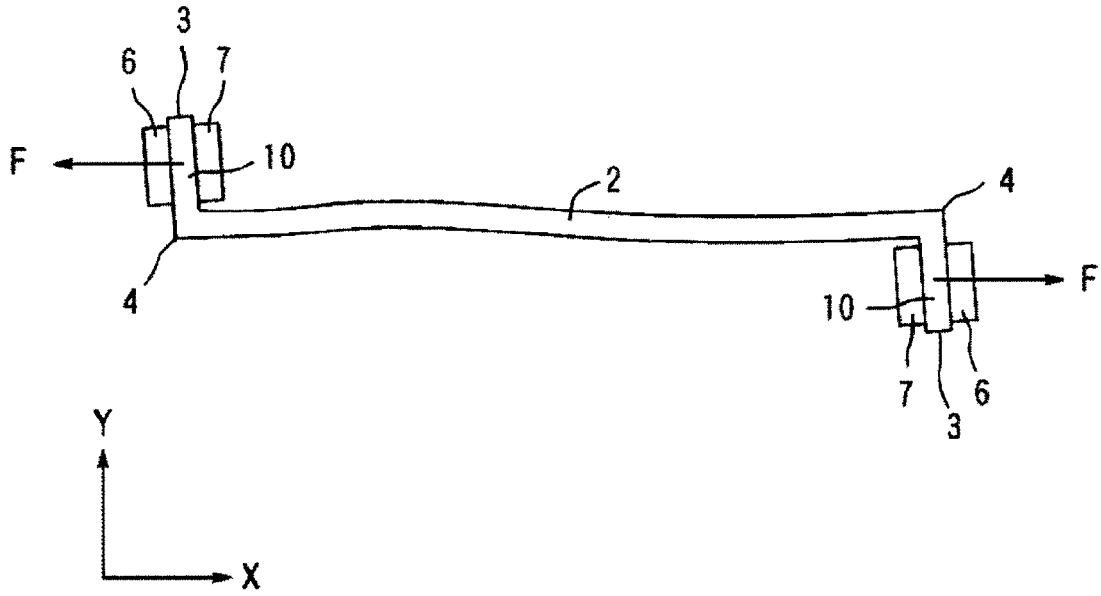
FIG. 4 is a diagram schematically illustrating the application of tension to the spacer.

A process of applying tension to the spacer 1 is performed by holding the grip portions 10 of the spacer 1 with the holding units 5 and moving the holding units 5 in the direction of the arrow A in FIG. 1B. FIG. 4 is a diagram illustrating an example of the shape of the spacer 1 when tension is applied to the grip portions 10 in the direction of an arrow F (X direction). In this case, as illustrated in FIG. 4, tension is applied to the grip portions 10 in the direction of the arrow F (X direction) and a rotational moment is applied to the longitudinal portion 2. As a result, the spacer 1 is distorted in the Y direction.

Figure 1C:
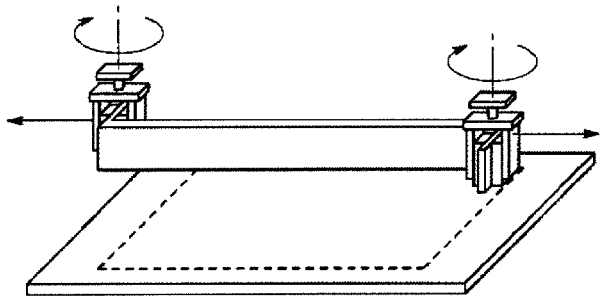

(Process of Rotating Grip Portions 10 of Spacer 1: FIG. 1C)

A process of rotating the grip portions 10 of the spacer 1 is performed by rotating the holding unit 5 around the rotation shaft 8 in the Z-axis with tension applied to the spacer 1. In this way, the rotational moment is applied to the spacer 1. In this case, in the process illustrated in FIG. 1B, in order to cancel the rotational moment applied to the longitudinal portion 2, the holding unit 5 is rotated around the rotation shaft 8 in the Z-axis such that tension is applied to the longitudinal direction.

Figure 1D:
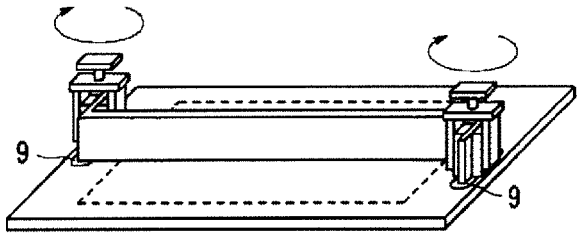

(Process of Fixing Spacer 1 to Rear Plate 11: FIG. 1D)

A process of fixing the spacer 1 is performed by fixing the spacer 1 to the rear plate 11 with the fixing member 9 outside the image region 12 of the rear plate. In this case, a predetermined positional relationship between the members outside the image region 12 is maintained. A region in which the spacer 1 is fixed by the fixing member 9 includes at least a portion of the longitudinal portion 2 that is disposed on the inside of the bending portion 4. The fixing region may include a region from the bending portion 4 to the end portion 3.

Figure 1E:
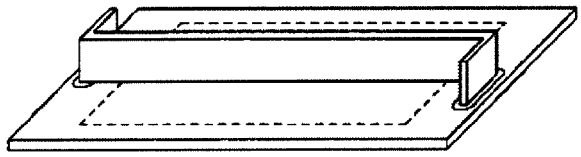

(Process of Releasing Tension of Holding Unit 5: FIG. 1E)

In a process of releasing the tension of the holding unit 5, after the spacer 1 is fixed to the rear plate 11 by the fixing member 9, the pressure of the air cylinder is eliminated, and the movable claw 7 of the holding unit 5 is moved in an opening direction. In this way, the holding unit 5 is detached from the spacer 1 fixed to the rear plate 11.

The processes illustrated in FIGS. 1A to 1E are repeatedly performed to arrange and fix the spacers 1 to the rear plate 11 at a predetermined pitch. In the above processes, the spacers are fixed one by one, but the invention is not limited thereto. A plurality of spacers may be fixed at the same time by the above processes. The above processes are repeatedly performed to arrange a predetermined number of spacers 1 on the rear plate 11 at a predetermined pitch.

Then, the rear plate 11 and the face plate (not illustrated) are aligned and are adhered with each other with a frame member (not illustrated) interposed therebetween to manufacture a hermetic container. In order to evacuate the hermetic container, a vacuum pump (not illustrated) is connected to an exhaust hole (not illustrated) formed in the rear plate 11 and evacuates the hermetic container. Then, the exhaust hole of the rear plate 11 is sealed. In this way, an image display apparatus is manufactured.

Figure 7:
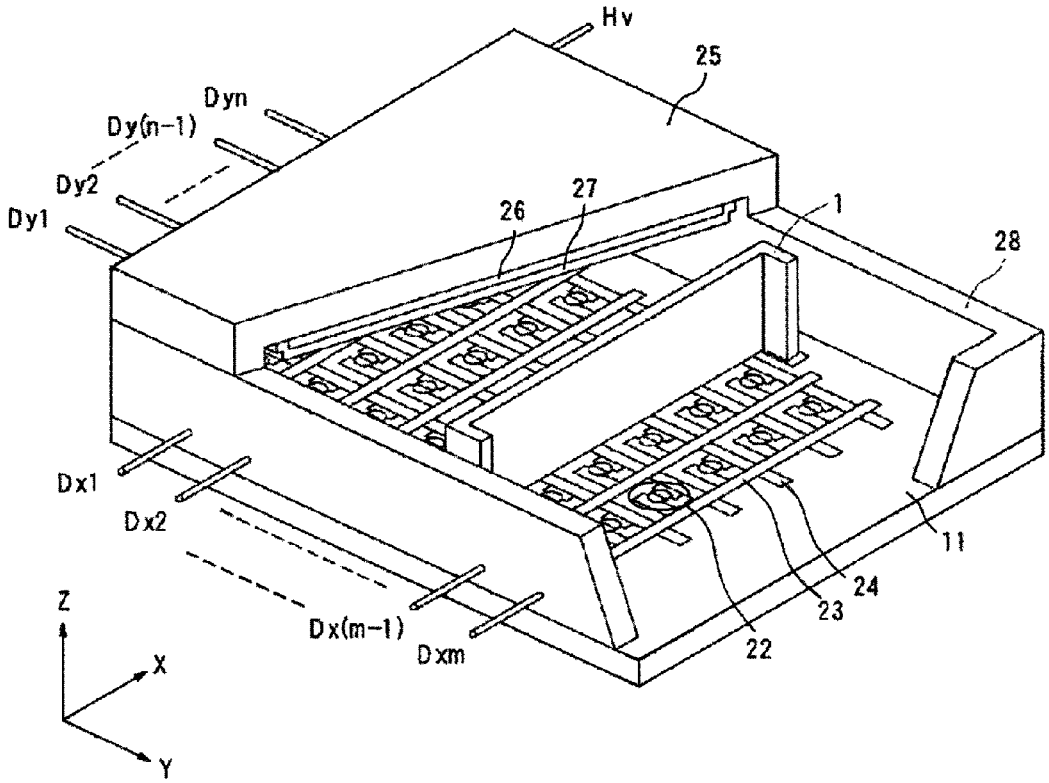
FIG. 7 is a diagram schematically illustrating an example of the structure of an image display apparatus according to an embodiment of the invention.

FIG. 7 is a diagram schematically illustrating the structure of an example of a display panel (hermetic container) of the image display apparatus manufactured in the embodiment of the invention. FIG. 7 is a schematic diagram illustrating an example of the display panel of the image display apparatus in which electron sources are arranged in a simple matrix, in which a portion of the display panel is cutout. In FIG. 7, reference numeral 11 denotes a rear plate, reference numeral 22 denotes an electron emitting device, reference numeral 23 denotes an X-direction wiring, and reference numeral 24 denotes a Y-direction wiring. In addition, reference numeral 25 denotes a face plate, which is a glass substrate, in which a phosphor film 26, which is a phosphor serving as a light emitting member, and a metal back plate 27, which is an anode, are formed. Reference numeral 28 denotes a supporting frame, and the rear plate 11 and the face plate 25 are attached to the supporting frame 28 with, for example, a frit glass interposed therebetween, thereby forming a hermetic container.

The invention will be described in detail below with reference to the following examples, but the invention is not limited to the following examples. In the following examples, the basic structure of the image display apparatus and a method for manufacturing the spacer are the same as those in Japanese Patent Application Laid-Open No. 2004-152602.

Example 1

Figure 5:
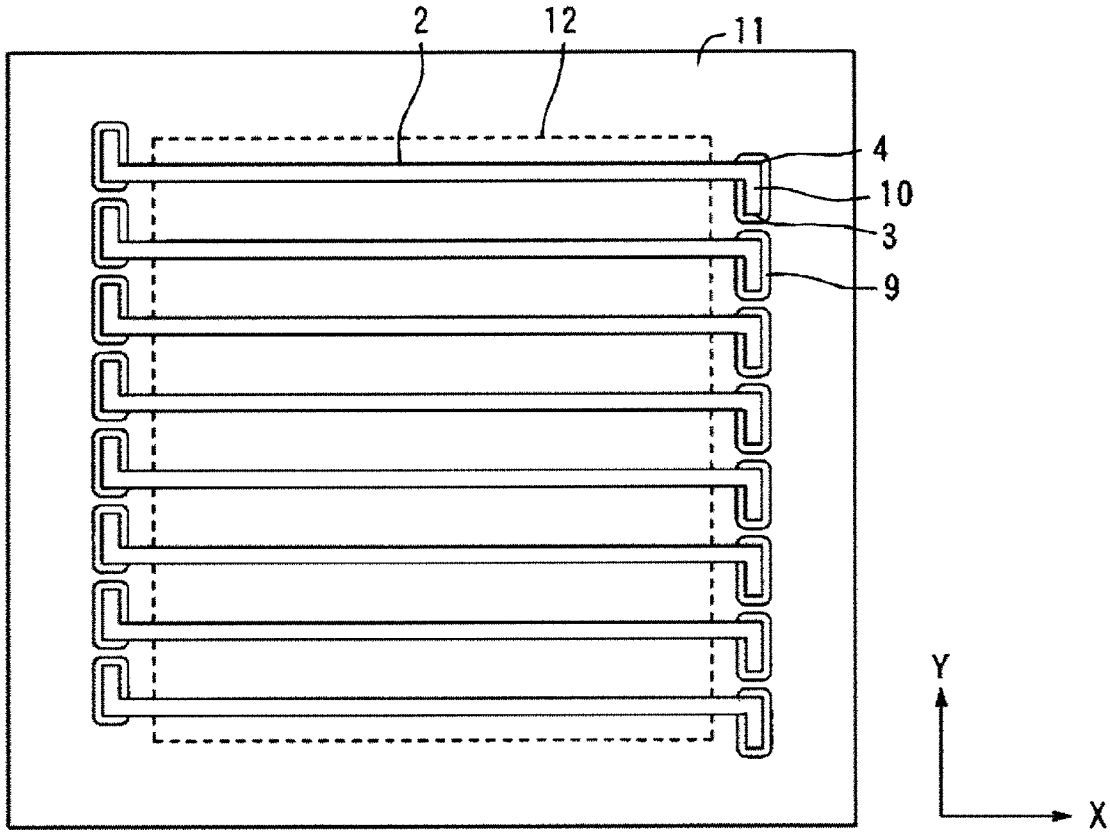
FIG. 5 is a diagram illustrating Example 1 of the invention.

The spacers 1 illustrated in FIG. 2A were attached to the rear plate 11 by the processes illustrated in FIGS. 1A to 1E. The rear plate 11 having the spacers 1 attached thereto is illustrated in FIG. 5. Next, the spacer 1 will be described.

The spacer 1 in which the angle θ of the bending portions 4 was 90° as illustrated in FIG. 2A was manufactured using a long spacer (1200 mm×2.0 mm×0.2 mm), which was an insulating member made of PD200 (manufactured by ASAHI GLASS CO., LTD). The bending portions 4 were formed by partially heating the long spacer with a laser to soften the spacer and bending the end portions 3 to the left and right side in the opposite direction. The length L of the longitudinal portion 2 of the spacer 1 was 1187 mm, the length L' from the end portion 3 to the bending portion 4 was 13 mm, and the angle θ of the bending portion 4 was 90°.

As illustrated in FIGS. 1A to 1E, each grip portion 10 that was 0.5 mm from the bending portion 4 to the outside was held by the holding unit 5 and a tension of 3.0 N was applied to the grip portion 10. In this case, since the grip portions 10 were drawn, moment was generated and the spacer 1 was distorted. In order to apply a rotational moment in a direction in which the moment was cancelled, the holding units 5 holding the two grip portions 10 were rotated by 0.2°. In this way, it was possible to maintain the linearity of the longitudinal portion 2.

An appropriate amount of inorganic adhesive whose degassing amount is small was applied as the fixing member 9 in a predetermined region of the bottom of the spacer 1 by a dispenser (not illustrated) and the spacer 1 was mounted on the rear plate 11 such that the region in which the adhesive was applied was disposed outside the image region 12 of the rear plate 11. Then, a heat gun (not illustrated) was used to blow hot air to the adhesive, thereby heating and hardening the adhesive. In this way, the spacer 1 was fixed to the rear plate 11.

The fixing region in which the adhesive was applied included a portion of the longitudinal portion 2 that is disposed on the inside of the bending portion 4 and a region from the bending portion 4 to the end portion 3, in order to extend the fixing region. In this way, even though attachment tension was applied to the spacer 1, it was possible to arrange the spacer 1 with an attachment accuracy of ±20 μm in the Y direction while reliably adhering and fixing the spacer 1 and maintaining the linearity of the spacer 1. In addition, it was possible to obtain the necessary and sufficient attachment accuracy of the spacer 1 and reduce a dead space. However, in this example, the adhesive is used as the fixing member 9, but the invention is not limited thereto. For example, a fixing pin may be used as the fixing member.

The above processes were repeated to arrange the spacers 1 on the rear plate 11 at a predetermined pitch as illustrated in FIG. 5, sufficiently align the rear plate 11 with the faceplate (not illustrated), and adhere the two substrates with a frame member (not illustrated) interposed therebetween, thereby manufacturing a hermetic container. In order to evacuate the hermetic container, a vacuum pump (not illustrated) was connected to the exhaust hole (not illustrated) formed in the rear plate 11 and evacuated the hermetic container. Then, the exhaust hole of the rear plate 11 was sealed. In this way, a vacuum container was manufactured. Then, an image display apparatus having a driver, a driving circuit, a high-voltage power supply, and a flexible circuits mounted therein was manufactured by a known method.

In the image display apparatus according to this example, the dead space was 20 mm which was smaller than that in the related art, and it was possible to reduce the weight of the image display apparatus. In addition, a high-definition and high-quality image display was obtained.

Example 2

Figure 6:
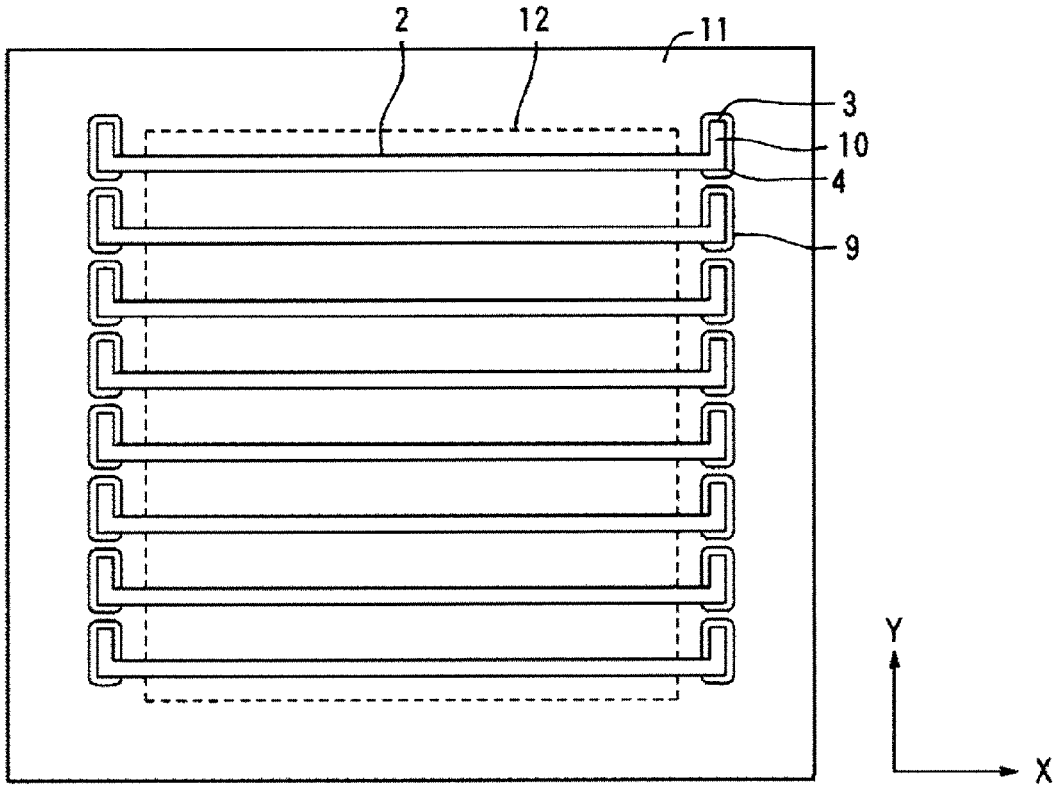
FIG. 6 is a diagram illustrating Example 2 of the invention.

In Example 2, an image display apparatus was manufactured in the same method as that in Example 1 except that the shape of the spacer 1 was different from that in Example 1. FIG. 6 is a diagram illustrating the rear plate 11 having the spacers 1 attached thereto in this example. The spacer 1 used in this example had the shape illustrated in FIG. 2B. The material, length, thickness, and height of the spacer 1 were the same as those in Example 1. In addition, in the spacer 1, the angle θ of one bending portion 4 was 90° and the angle θ of the other bending portion 4 was 270°.

In the spacer 1 used in this example, unlike Example 1, the end portions 3 were bent in the same direction by the bending portions 4. In a process of rotating the grip portions 10 in the XY plane, one spacer holding unit 5 was rotated around the shaft by 0.2°, and the other spacer holding unit 5 was rotated around the shaft by −0.2°. In this way, it was possible to maintain the linearity of the longitudinal portion 2.

In the image display apparatus according to this example, the dead space was 20 mm which was smaller than that in the related art, and it was possible to reduce the weight of the image display apparatus. In addition, a high-definition and high-quality image display was obtained.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-161327, filed on Jul. 8, 2009, which is hereby incorporated by reference herein its entirety.

What is claimed is:

1. A method for manufacturing an image display apparatus having a first substrate, a second substrate that is arranged so as to face the first substrate, and a plate-like spacer that is provided between the first substrate and the second substrate, wherein the spacer includes bending portions that are provided inside of both end portions and are bent in a plane orthogonal to a direction in which the first substrate and the second substrate face each other, the method comprising the steps of:

holding grip portions that are provided between the bending portions and the end portions of the spacer;

applying tension to the spacer whose grip portions are held in a longitudinal direction of the spacer;

rotating the grip portions of the spacer in a direction in which the tension is applied to the spacer in the longitudinal direction in the plane orthogonal to the direction in which the first substrate and the second substrate face each other; and fixing at least a portion of the spacer that is disposed inside the bending portions to the first substrate.

* * * * *